US007886902B1

(12) United States Patent
Cimini et al.

(10) Patent No.: US 7,886,902 B1
(45) Date of Patent: Feb. 15, 2011

(54) MAGNETIC STORAGE POCKET

(75) Inventors: Andrew Cimini, Lebanon, TN (US); Michael Fox, Madison, TN (US)

(73) Assignee: Dynamic Brands, LLC, Richmond, VA (US)

( * ) Notice: Subject to any disclaimer, the term of this patent is extended or adjusted under 35 U.S.C. 154(b) by 1052 days.

(21) Appl. No.: 11/371,645

(22) Filed: Mar. 9, 2006

(51) Int. Cl.
*A63B 55/00* (2006.01)

(52) U.S. Cl. ..... 206/315.5; 2/248; 2/251; 190/126; 190/900; 206/818; 206/303; 24/303

(58) Field of Classification Search ..... 2/247–252; 190/126, 900, 158; 224/183; 206/818, 315.5; 24/303
See application file for complete search history.

(56) References Cited

U.S. PATENT DOCUMENTS

| | | | | | |
|---|---|---|---|---|---|
| 50,582 | A | * | 10/1865 | Hickman | 2/251 |
| 645,444 | A | * | 3/1900 | White et al. | 2/264 |
| 1,709,582 | A | * | 4/1929 | Kahle | 206/315.5 |
| 1,984,150 | A | * | 12/1934 | Ottinger | 383/86 |
| 2,711,234 | A | * | 6/1955 | Rubens | 190/26 |
| 3,111,737 | A | * | 11/1963 | Heil | 24/303 |
| 4,033,013 | A | * | 7/1977 | Peterson | 24/303 |
| 4,609,084 | A | * | 9/1986 | Thomas | 190/110 |
| 4,768,650 | A | * | 9/1988 | Chancellor, Jr. | 206/315.3 |
| 5,865,482 | A | * | 2/1999 | Aoki | 292/251.5 |
| 5,933,926 | A | * | 8/1999 | Reiter | 24/303 |
| 5,988,379 | A | * | 11/1999 | Yearous | 206/315.3 |
| 2007/0193902 | A1 | * | 8/2007 | Myers et al. | 206/320 |

* cited by examiner

*Primary Examiner*—Tri M Mai
(74) *Attorney, Agent, or Firm*—Troutman Sanders LLP; Bernard G. Pike

(57) ABSTRACT

A magnetically fastened storage pocket for a storage container such as a golf bag. A fabric pocket provides overlapping pocket panels that are arranged to accommodate one-handed opening/closing operations. A fastener assembly includes mating magnetic pieces. Resilient stay member(s) having shape retaining properties and fittings and/or elastic members define and resiliently maintain the pocket shape and align the pocket and magnet pieces.

14 Claims, 2 Drawing Sheets

MAGNETIC STORAGE POCKET

FIELD OF THE INVENTION

The present invention relates to storage pockets and in particular to an easy access storage pocket for a golf bag where golf balls and other accessories are accessible with a single hand.

Storage bags exist in vast numbers of different sizes and shapes for various paraphernalia. The bags generally include a primary compartment and frequently include secondary compartments for items associated with or complementary to the items stored in the primary storage space. The secondary compartments are typically arrayed around the exterior of the primary storage space. Straps and handles may also be provided to facilitate transport of the bag. Some common exemplary storage bags are backpacks, briefcases, duffle bags, clothes bags, electronics cases/pouches, fishing tackle bags and golf bags, to name a few.

Depending upon the stored items, the closure mechanisms provided can vary. Frequently used fasteners are zippers, grommets with lacing, mating strips of hook/loop fastener material, snaps, clasps, draw fasteners, interlocking plastic clips and various other interlocking assemblies. The type of fastener selected frequently depends upon construction of the bag/case. Each fastener secures an opening to a primary or secondary storage space. The relative of ease of access to the storage space varies with the type of fastener.

The present invention discloses a closure/fastener assembly that provides a secure fastening, yet permits ready access to the adjoining storage space. The closure assembly finds particular advantage with storage compartments/pockets arrayed about fabric containers such as a golf bag. The closure is secured to a peripheral edge of a compartment/pocket that may contain frequently accessed items such as balls and tees.

The closure assembly accommodates a one-handed opening/closing operation. The assembly includes mating magnetic pieces that cooperate with a resilient member having shape retaining memory properties fitted to overlapping edge pieces. The magnetic pieces maintain the closure and the resilient member gently resists opening and guides the magnet pieces into alignment during closure. Elastic and other resilient materials can be combined to enhance opening/closing resistance and the rate of return to a closed condition and shape.

SUMMARY OF THE INVENTION

It is a primary object of the present invention to provide a storage pocket having a flap or cover piece or panel that overlaps and seals to a flap or panel that defines a storage space.

It is a further object of the invention to provide a resilient fabric storage pocket having overlapping cover/flap and storage space defining pieces adapted to one-handed opening/closing and which pieces return to shape upon release.

It is a further object of the invention to provide a magnetic coupling between the cover/flap and storage pieces.

It is a further object of the invention to provide a fastener for a pocket piece that provides a number of magnets at one pocket piece that align to grommets or other complementary magnetic members fitted to an adjoining pocket piece.

It is a further object of the invention to provide a resilient member or stay that is supported at one or both of a cover/flap and storage pieces to resist separation and induce the return of the cover and storage pieces to a defined alignment.

It is a further object of the invention to provide a resilient member constructed of a tensile material that is shaped and/or supported to provide resilient resistance to opening/closing.

It is a further object of the invention to provide a coiled spring member, shaped fiberglass member or other relatively stiff and resilient member arrayed and fitted to one of more pocket pieces to resiliently support and align adjoining pocket pieces.

It is a further object of the invention to provide an elastic member fitted to a pocket piece.

The foregoing objects are achieved in a presently preferred golf bag assembly, which includes a magnetically fastened accessory pocket. The pocket provides overlapping flaps or panels that are resiliently biased to provide resilient resistance to opening/closing and direct the pocket panels to defined orientations. One or more magnetic members mounted to one pocket panel are aligned to interact with an adjoining panel. Metal grommets that ventilate the pocket and can support pull-tabs cooperate with the magnets to fasten the pocket pieces together.

A resilient stay fitted to the peripheral edge of an adjoining storage piece is arranged to gently resist opening and induce the piece back to a preferred alignment upon release of the piece. A spiral wound spring member is presently secured to the pocket panel to provide resistance.

In an alternative construction, a formed fiberglass member is fitted to define a U-shape at the pocket panel to resiliently bias the pocket to an open condition. Elastic edging or facing pieces fitted to the cover and/or pocket panels enhance resilience. The numbers, configuration, orientation and/or types of magnets, stays and elastic facing can be varied as desired to enhance access.

Still other objects, advantages and constructions of the present invention, among various considered improvements and modifications, will become apparent from the detailed description provided hereinafter. It should be understood that the detailed description and specific examples, while indicating a presently preferred embodiment of the invention, are intended for purposes of illustration only and are not intended to limit the scope of the invention.

BRIEF DESCRIPTION OF THE DRAWINGS

The present invention will become more fully understood from the following detailed description and accompanying drawings, wherein similar reference callouts are used at the various figures, and wherein.

DETAILED DESCRIPTION OF THE PREFERRED EMBODIMENTS

The following description of presently preferred embodiment(s) is provided to describe exemplary constructions of the invention. The description is not intended to limit the invention, its construction, application, or uses. For purposes of clarity, the same reference numbers are used throughout the drawings to identify similar components.

Figure 1:
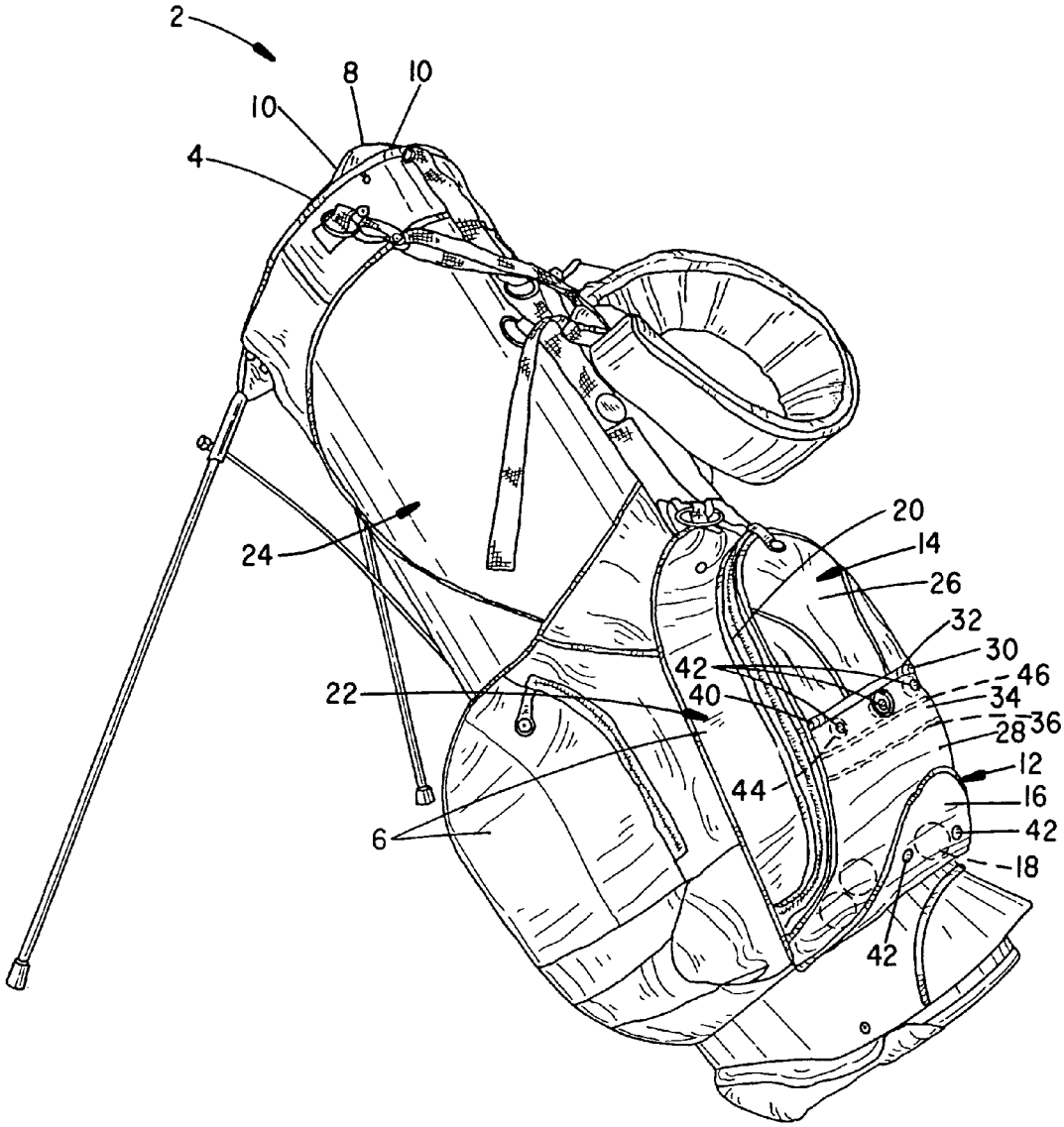
FIG. 1 shows a perspective view to a golf bag outfitted with a magnetically fastened pocket assembly of the invention.
Figure 2:
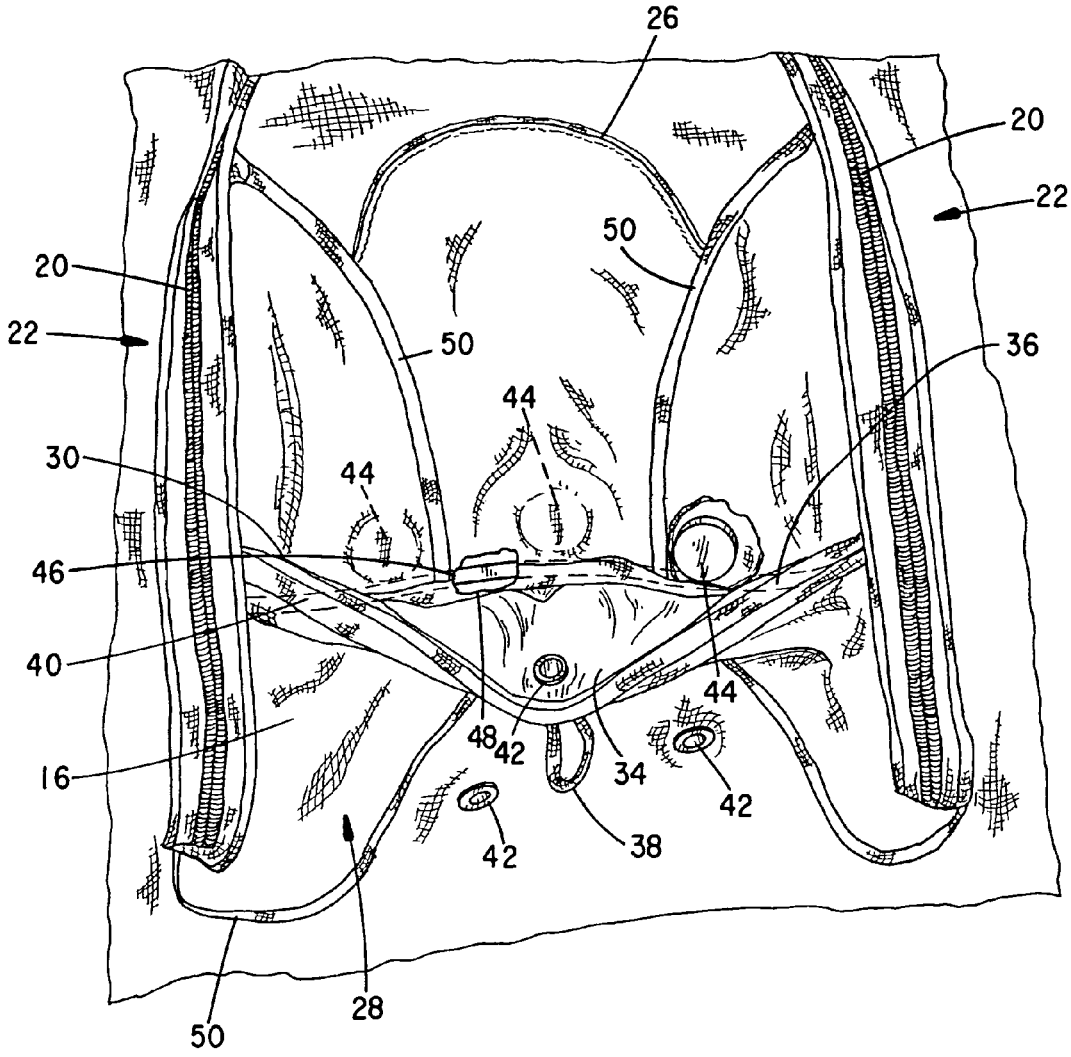
FIG. 2 shows an enlarged, detailed drawing in partial cutaway and wherein an upper panel piece is extracted and exposed over an edge of a lower panel piece to expose the magnetic fasteners and a soft trim piece.

Referring to FIG. 1 a view is shown to a golf bag 2 having a club storage space 4 and several accessory storage pockets 6 arrayed about the exterior surface of the bag 2. The storage space 4 is segregated with dividers 8 into several compartments 10 that retain one or more clubs (not shown) in desired alignments to facilitate club access, yet prevent the clubs from jostling into one another during play and/or transport. The dividers 8 can be constructed from a molded plastic end piece that is covered with a fabric material. The storage pockets 6 conveniently retain a variety of accessories and paraphernalia such as balls, tees, shoes, clothing, umbrella, sunscreen and any number of items a golfer may desire during play.

Prominently located on the front of the bag 2 is a "quick grab" pocket 12 intended to contain extra balls and/or tees. A front panel assembly 14 of the pocket 12 is constructed to facilitate opening and/or closing with one hand and protect the stored items from the weather, yet prevent inadvertent release or spillage of the stored items. Although only one pocket is provided several other similar pockets 12 can be arrayed about the bag 2.

The pocket 12 is displaced away from an interior bag wall to provide a hollow storage space 16. Balls 18 (shown in dashed line), tees and other frequently accessed items can be stored in the pocket 12. The storage space 16 is accessible in alternative fashions. One means of access to the storage space 16 is a two-way zipper 20 that extends around both sides and the top of the panel assembly 14 to expose the storage space 16. Alternatively, the storage space 16 is accessible via the front, "quick grab" panel assembly 14 as discussed below.

The pocket assembly 12 is constructed in three primary pieces. A side panel piece 22 is sewn to a wall of the bag 2. The side panel piece 22 is formed, trimmed and/or lined to stand away from an interior rear pocket wall which is defined by a panel assembly 24 that defines the club storage space 4. A portion of the front of the panel 24 defines an interior rear wall of the pocket 12.

An upper panel piece 26 of the "quick grab" panel 14 spans a portion (e.g. slightly greater that one-half) of the space 16. A lower panel piece 28 spans the remaining portion of the space 16 and overlaps the upper panel piece 26 at a trimmed edge 30 where an opening 32 is provided. The zipper 20 joins the raised, adjoining edges of the upper and lower pocket panels 26 and 28 to the side panel piece 22. The opening 32 provides a convenient alternative, one-handed access to the storage space 16 which embodies a primary advantage of the invention.

The upper panel piece 26 includes a facing or trim piece 34 that is covered by the lower panel 28. The trim piece 34 is constructed of a resilient, soft, elastic material that is edged with an elastic facing 36. Upon accessing the opening 32 and inserting a hand past the edge 30, the trim piece 34 and facing 36 flex and form about the hand and wrist to permit access to the storage space 16 without abrading the hand and/or wrist. Access can be facilitated upon manipulating a pull tab 38 made of a knotted length of cording that is secured to the panel 26 to facilitate access to the storage space 16. Upon pulling the tab 38 and drawing the edge 30 away from the panel piece 26, the fingers are wrapped over the edge 30 and the hand is inserted into the storage space 16.

Secured to the edge 30 is an elastic trim or facing piece 40. A number of metal grommets 42 are arrayed beneath the facing piece 40 and align with magnets 44 (shown in dashed line and sewn into the panel piece 26). A resilient stay member 46 (shown in cutaway) is fitted into the panel 26 beneath the magnets 44 and spans the width of the trim piece 34. The stay 46 is constructed of a spiral wound spring material and exhibits a tensile memory that permits flexion of the interior, lower edge of the panel piece 26 at the trim piece 34. The stay 46 is sewn into a stay sleeve 48. The length and configuration of the sleeve 48 is adjusted to pre-stress the stay 46 to define a preferred orientation at the panels 26 and 28.

The stay 46 can be constructed of a variety of materials (e.g. metal, plastic, nylon, fiberglass or another flexibly resilient material) and can be formed to a variety of shapes (e.g. flat, straight or irregular strips; round; rod; or tubular). The stay 46 desirably exhibits a sufficient rigidity to define a preferred shape at the opening 32 commensurate with the closed and open conditions desired at the pocket 12 and opening 32. The tensile properties of the material can be defined as desired and the stay(s) 46 can be positioned in any desired alignment to the pocket panels 26 and 28. Multiple stays 46 may also be provided at one or both panels 26 and/or 28 to further define the storage space 16, such as by mounting the additional lengths of the stays 46 into the decorative facing pieces 50 and arraying the facing pieces 50 to enhance the desired the shape of the space 16.

Upon inserting the hand into the opening 32 and between the panels 26 and 28, the trim 34 stretches and the stay 46 flexes. Upon withdrawing the hand and an item selected from the pocket 12, the trim 34 and stay 46 collectively spring back to shape and re-align the magnets 44 to the grommets 42. The magnetic field between the magnets 44 and grommets 42 maintains the fastening. The grommets 42 also serve to ventilate the pocket 14.

The magnets 44 can be constructed of a variety of materials and compounds to any desired shape. The magnets 44 are presently constructed to exhibit a preferred field attraction relative to the adjoining fastener member. The magnets 44 can be bonded to the pocket panel(s) 26 and/or 28 as described above or by stitching, with suitable adhesives or other fasteners. In lieu of grommets 42, solid metallic pieces can also be fitted in pouch(s)/sleeve(s) beneath the adjoining panel piece.

From the foregoing, it is to be appreciated the described construction of the "quick grab" pocket assembly 12 is merely exemplary of a presently preferred configuration. From the suggested modifications and others that may be apparent to those skilled in the art, it is to be appreciated the invention can be implemented in still other configurations and to several different pockets. For example, the panel 26 can be fitted to overlap the panel 28 to provide a weatherproof cover with the trim 34 secured to the panel 28 and/or with the tab secured to the panel 26. The magnets 44, grommets 42 and stays 46 can be arranged in a variety of desired configurations to enhance the attractive forces and air flow through the storage space 16. Still further, the magnets 44 and stays 46 might be adapted into other bags, cases or storage assemblies. The scope of the invention should therefore not be construed merely to the foregoing description, but rather should be construed within the broader scope of the following claims.

What is claimed is:

1. A storage pocket assembly comprising:

a) a storage container including a plurality of panels coupled together to define a storage space and wherein first and second panels overlap to define one wall and a first opening to said storage space;

b) a flexibly resilient stay member mounted to one of said first and second panels to displace said first and second panels away from an opposite wall of said storage panel and maintain a preferred alignment between said first and second panels;

c) first and second mating zipper pieces mounted to at least one of said panels to define a second opening to said storage space; and d) a magnetic fastener secured to overlapping first and second panels comprising a magnetic member fitted to one of said first and second panels and a magnetically attractive member secured to the other of said first and second panels, wherein said magnetically attractive member is located within the magnetic field of said magnetic member and mounted to detachably secure said first and second panels together in a closed condition to close said opening to said storage space and wherein at least one of said first and second panels can be flexed apart from the other to separate said magnetic member and expose said storage space.

2. A pocket assembly as set forth in claim 1 wherein said magnetically attractive member comprises a metallic grommet.

3. A pocket assembly as set forth in claim 1 including a pull tab located to facilitate a separation between said first and second panels.

4. A pocket assembly as set forth in claim 1 including a soft, flexibly resilient trim piece secured to a peripheral edge of the underlying one of said first and second panels, whereby the hand and wrist are cushioned during entry and withdrawal from the storage space.

5. A golf bag as set forth in claim 1 wherein said magnetically attractive member exhibits an opposite magnetic polarity to said magnetic member.

6. A golf bag comprising:

a) a plurality of panels coupled together to define an elongated storage space for a plurality of golf clubs;

b) a first interconnecting fastener secured to adjoining panels and operable to define a first aperture to an accessory storage space;

c) first and second panels comprising a wall of said accessory storage space and mounted to overlap to define a second opening to said accessory storage space;

d) a flexibly resilient member comprising a spiral wound member fitted within a sleeve and mounted to one of said first and second panels to displace said first and second panels away from an opposed wall of said accessory space; and e) a magnetic fastener secured to said first and second panels comprising a magnetic member fitted to one of said first and second panels and a magnetically attractive member secured to the other of said first and second panels, wherein said magnetically attractive member is located within the magnetic field of said magnetic member and mounted to detachably secure said first and second panels together in a closed condition and close a second aperture to said accessory space, and wherein at least one of said first and second panels can be flexed apart from the other to separate said magnetic member and expose said accessory space.

7. A golf bag as set forth in claim 6 wherein said magnetically attractive member comprises a metallic grommet.

8. A golf bag as set forth in claim 6 including a pull tab located to facilitate a separation between said first and second panels.

9. A golf bag as set forth in claim 6 including a soft, flexibly resilient trim piece secured to a peripheral edge of the underlying one of said first and second panels, whereby the hand and wrist are cushioned during entry and withdrawal from the accessory space.

10. A golf bag as set forth in claim 6 wherein said magnetically attractive member exhibits an opposite magnetic polarity to said magnetic member.

11. A golf bag comprising:

a) a plurality of panels coupled together to define an elongated storage space for a plurality of golf clubs and including a divider member secured to an open end to separate said golf clubs;

b) a first interconnecting fastener secured to adjoining panels and operable to define a first aperture to an accessory storage space;

c) first and second panels comprising a wall of said accessory storage space and mounted to overlap to define a second opening to said accessory storage space and a soft, flexibly resilient trim piece secured to a peripheral edge of at least one of said first and second panels;

d) a flexibly resilient member comprising a spiral wound member fitted within a sleeve and mounted to one of said first and second panels to displace said first and second panels away from an opposed wall of said accessory space; and e) a magnetic fastener secured to said first and second panels comprising a plurality of magnetic members fitted to one of said first and second panels and a plurality of metallic members secured to the other of said first and second panels, wherein said metallic members are located within the magnetic field of said magnetic members and mounted to detachably secure said first and second panels together in a closed condition and close a second aperture to said accessory space, and wherein at least one of said first and second panels can be flexed apart from the other to separate said magnetic members and expose said accessory space.

12. A golf bag as set forth in claim 11 wherein said metallic member comprises a grommet.

13. A golf bag as set forth in claim 11 including a pull tab located to facilitate a separation between said first and second panels.

14. A golf bag as set forth in claim 11 wherein said trim piece includes elastic fibers.

* * * * *